US007406724B2

(12) United States Patent
Miller

(10) Patent No.: US 7,406,724 B2
(45) Date of Patent: Aug. 5, 2008

(54) TWIN BABY BED

(76) Inventor: Angela L. Miller, 2216 NW. 37th St., Oklahoma City, OK (US) 73120

( * ) Notice: Subject to any disclaimer, the term of this patent is extended or adjusted under 35 U.S.C. 154(b) by 95 days.

(21) Appl. No.: 11/588,948

(22) Filed: Oct. 30, 2006

(65) Prior Publication Data

US 2008/0098520 A1 May 1, 2008

(51) Int. Cl.
*A37D 13/06* (2006.01)

(52) U.S. Cl. ..... 5/93.1; 5/100; 5/424

(58) Field of Classification Search ..... 5/93.1, 5/100, 424, 428

See application file for complete search history.

(56) References Cited

U.S. PATENT DOCUMENTS 2,471,691 A 5/1949 Hurst
2,704,371 A 3/1955 Liphart
7,017,204 B1 * 3/2006 Fertil et al. ..... 5/93.1
7,266,853 B2 * 9/2007 Kasem ..... 5/93.2

OTHER PUBLICATIONS

Gray, UK Patent application 2,113,987 A, Published Aug. 17, 1983.

* cited by examiner

*Primary Examiner*—Fredrick C. Conley
(74) *Attorney, Agent, or Firm*—William S. Dorman

(57) ABSTRACT

A generally rectangular baby bed comprised of a vertical headboard, a vertical footboard, a pair of vertical side panels connecting from the headboard to the footboard, a flat horizontal supporting surface extending between the headboard and the footboard for supporting a mattress thereon, a pair of vertical side panels extending between the headboard and the footboard, a central vertical partition mounted between the side panels in parallel relation therewith and extending from the headboard to the footboard, the central partition being formed of an upper horizontal rail, a lower horizontal rail and a plurality of vertical rails which extend from the upper rail to the lower rail, a pair of opposed vertical slots located opposite each other on the inboard sides of the headboard and footboard for receiving therein the ends of the upper and lower horizontal rails, whereby the vertical partition is slidable vertically upwardly and downwardly in the vertical slots, rollers mounted at the ends of the horizontal rails for the central partition for allowing rolling movement of the vertical partition in the vertical slots.

5 Claims, 3 Drawing Sheets

TWIN BABY BED

BACKGROUND OF THE INVENTION

1. Field of the Invention

The present invention relates to a twin baby bed and more particularly to a baby bed having a slidable longitudinal partition which allows the bed to be used for twins.

2. Prior Art

Searches were made in the prior art for beds similar to the present invention and the following listed patents are considered to be the most pertinent uncovered:

| PATENT | INVENTOR | DATE |
|---|---|---|
| U.S. Pat. No. 2,471,691 | F. M. Hurst | May 31, 1949 |
| U.S. Pat. No. 2,704,387 | F. L. Liphart | Mar. 22, 1955 |
| U.K. Patent No. 2,113,987 A | M. Gray | Aug. 17, 1983 |

The Hurst patent is pertinent in that it shows a bed or crib having a movable longitudinal partition for varying the width of the crib.

Liphart is pertinent in that it shows a bed having a central longitudinal partition for dividing double beds into separate portions.

The British patent is pertinent in that it shows a transverse movable partition.

SUMMARY OF THE INVENTION

The present invention involves a generally rectangularly shaped baby bed comprised of a vertical headboard, a vertical footboard arranged in spaced parallel relation with the headboard, a flat horizontal supporting surface extending between the headboard and the footboard intermediate the heights of the headboard and footboard, a pair of side panels extending between the headboard and the footboard and comprised of horizontal rails extending between the headboard and a footboard and vertical rails extending downwardly from the horizontal rails to the horizontal supporting surface. A central vertical partition is mounted between the side panels and is formed of an upper horizontal rail a lower horizontal rail and a plurality of vertical rails which extend between the two horizontal rails. At the ends of the horizontal rails are rollers which are received in vertical slots located opposite each other on the inboard sides of the headboard and footboard. The rollers permit vertical sliding movement of the partition within the slots and even removal of the partition if desired.

For the purpose of locking the partition in place a locking device is provided consisting of a rod or shaft adapted to be received in a hole in the footboard and having an end extending inwardly into the bed overlying one of the rollers to lock the partition in position.

For the purpose of providing comfort and amusement to the occupant or occupants of the baby bed, a mobile can be provided on the headboard and also a light scene can be provided on the headboard.

DETAILED DESCRIPTION OF THE PREFERRED EMBODIMENTS

Figure 1:
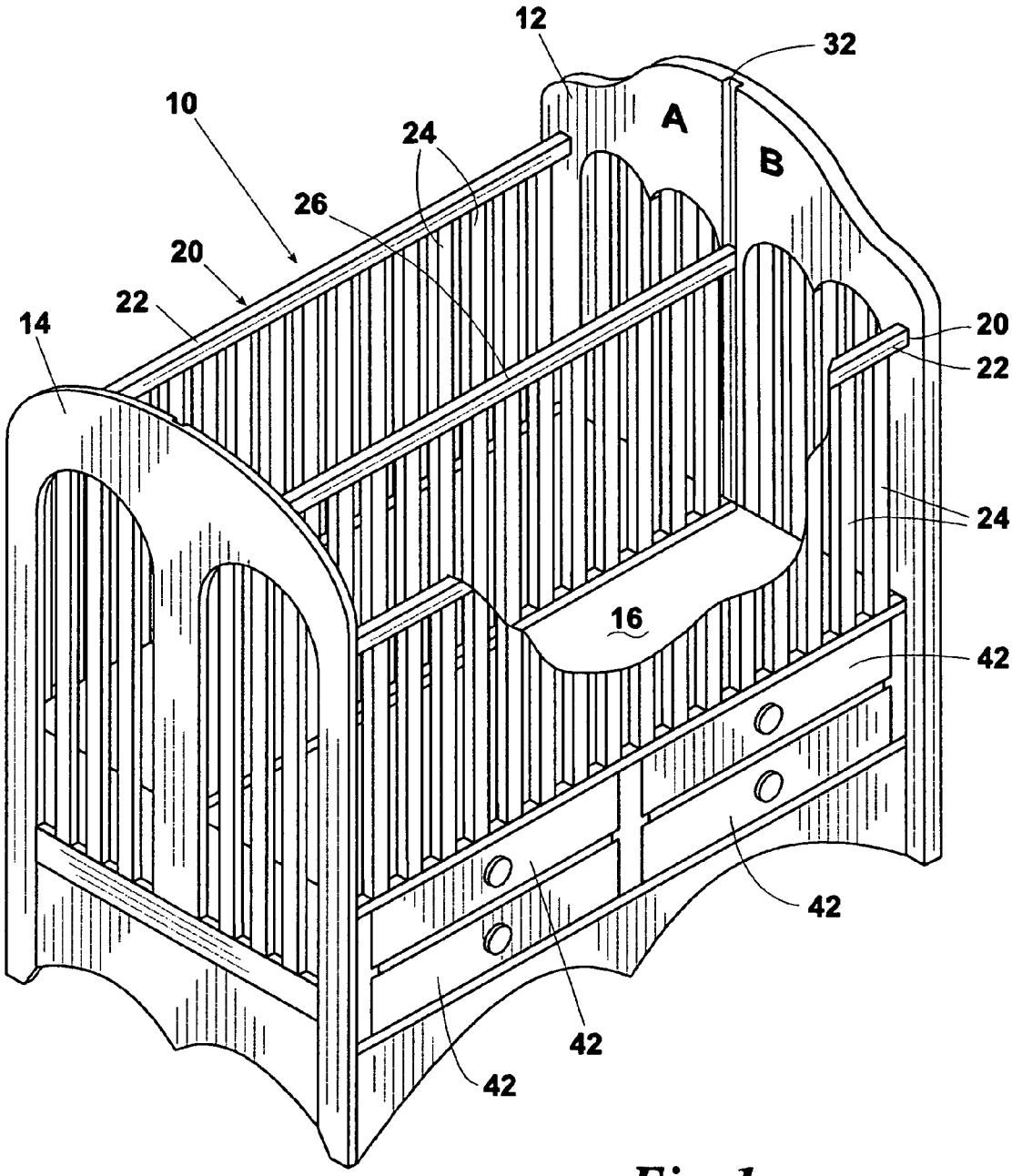
FIG. 1 is a perspective view of a baby bed showing a cental longitudinal partition slidable in slots on the headboard and foot board and with multiple drawers on the sides of the bed.
Figure 3:
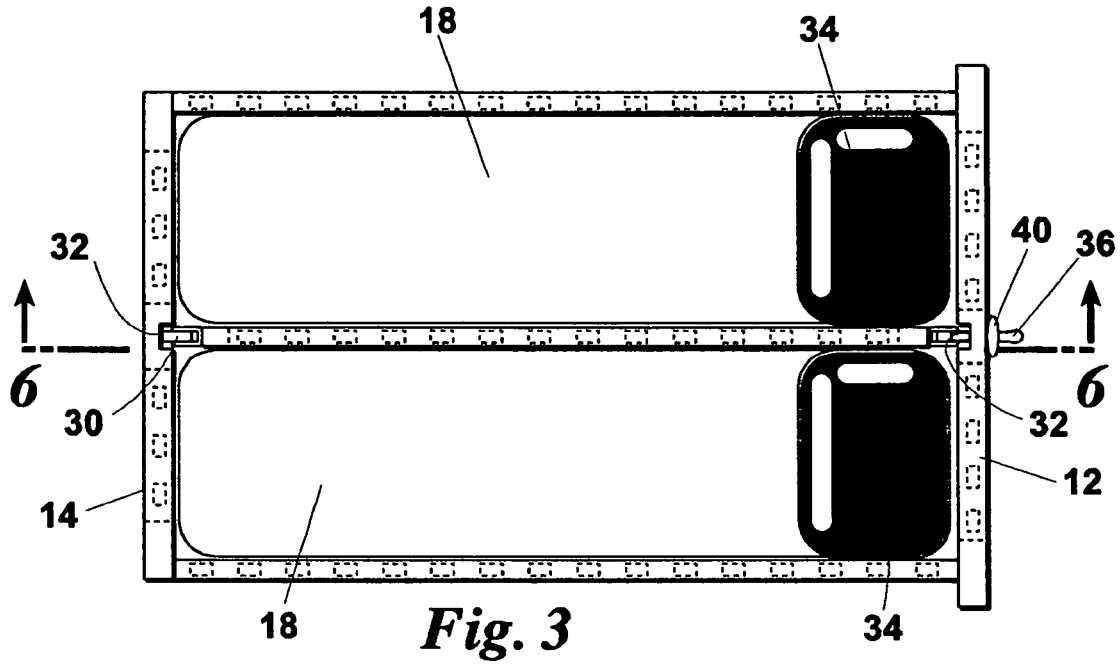
FIG. 3 is a plan view of the twin baby bed.

Referring to the drawings in detail, FIG. 1 shows a bed 10, generally rectangular in shape and comprised of a vertical headboard 12 (to the rear or right), a vertical footboard 14 (in the foreground), longitudinal supports (not shown) which connect with the headboard and footboard in a conventional manner with conventional hardware (not shown), a flat horizontal supporting surface or bed 16 for supporting a mattress or mattresses 18 thereon (see FIGS. 3 and 6) and vertical side panels 20 formed of horizontal rails 22 extending between the footboard and headboard and vertical rails 24 extending downwardly from the horizontal rails 22 to the horizontal supporting surface 16.

Mounted between the side panels 20 is a central vertical partition formed of an upper horizontal rail 26, a lower horizontal rail 28 and a plurality of vertical rails 24 which extend from the upper rail to the lower rail. At the ends of the horizontal rails 26 and 28 are rollers 30 which are received in vertical slots 32 located opposite each other on the inboard sides of the headboard 12 and footboard 14. The rollers 30 permit vertical sliding movement of the partition within the slots 32 and even removal of the partition if desired. When in place, the partition separates the bed longitudinally into two areas or bed portions to accommodate, for example, a set of twins (not shown), as exemplified by the illustration in FIG. 3 which shows two side-by-side mattresses 18, each occupying one-half the width of the bed and having pillows 34 received thereon adjacent the headboard 12.

Figure 6:
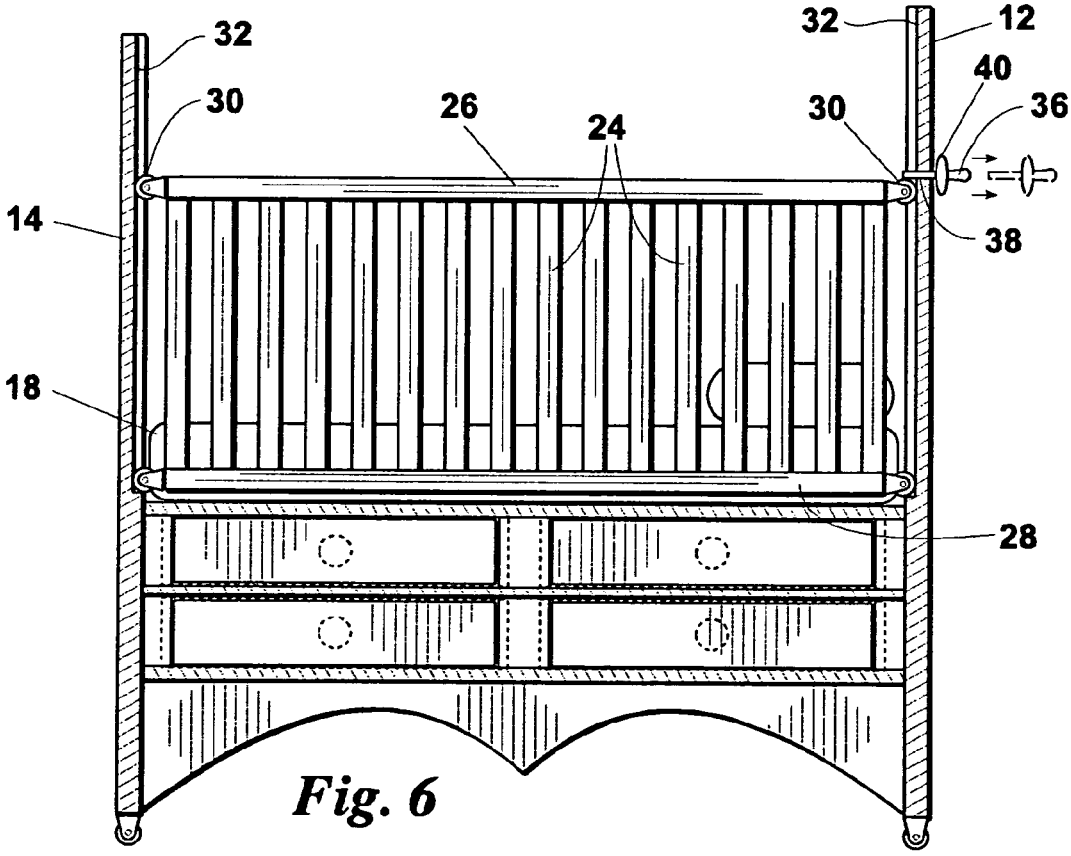
FIG. 6 is a left side view taken from FIG. 4 with certain parts in section to show the lock for the partition.

For the purpose of locking the partition in the position shown in FIG. 6, a locking device is provided consisting of a rod or shaft 36 adapted to be received in a hole 38 provided in the headboard 12, so that the left hand end of the rod 36 overlies one of the rollers 30, as best shown in FIG. 6, to lock the partition in position. If desired, the left hand end of the rod 36 could be received in a hole (not shown) provided in any convenient location in the partition as an alternative to overlying a roller 30.

Figure 2:
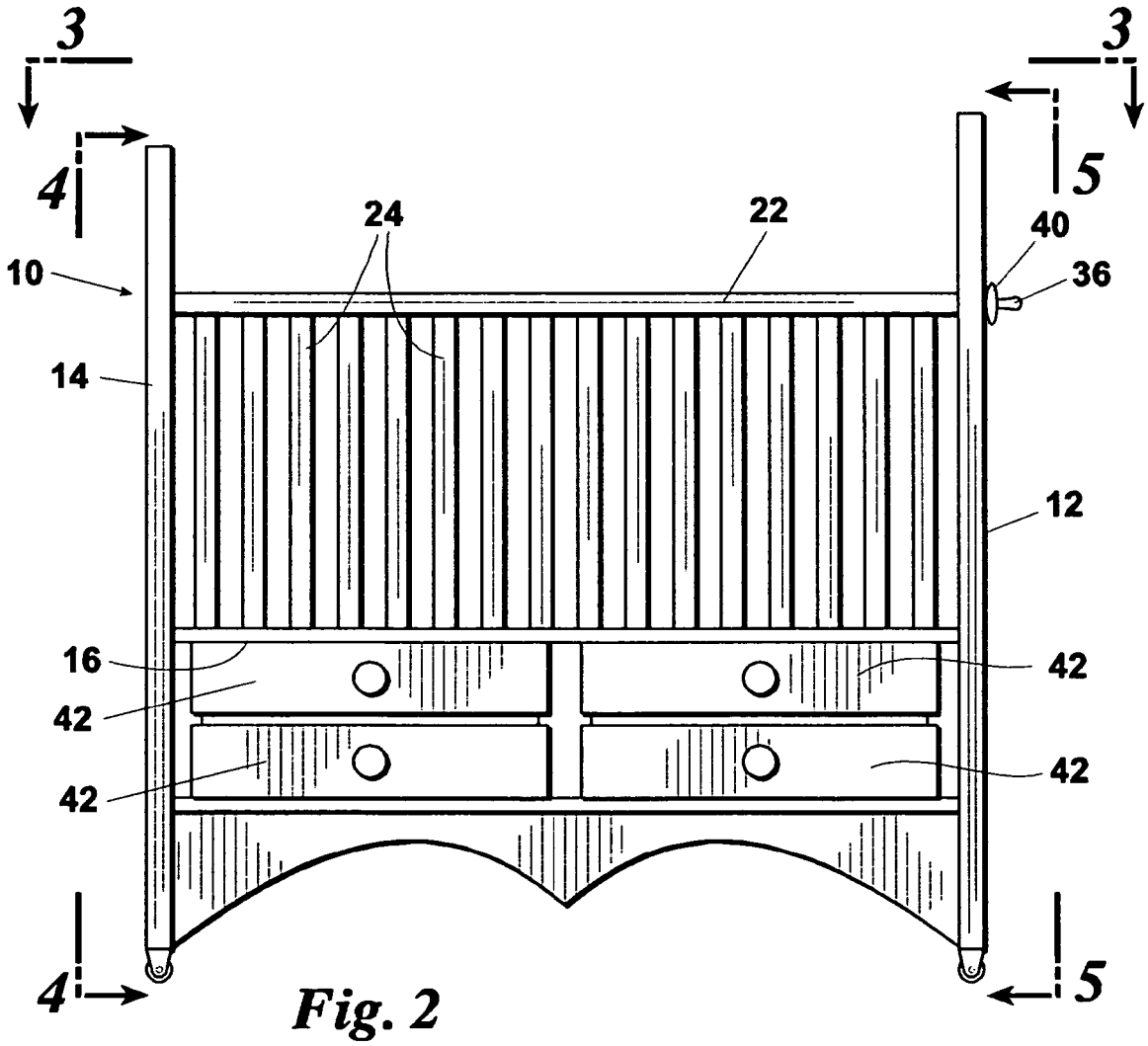
FIG. 2 is a right side elevation of the bed showing the drawers located along the lower side of the bed and also showing a locking device for locking the partition in fixed position.
Figure 4:
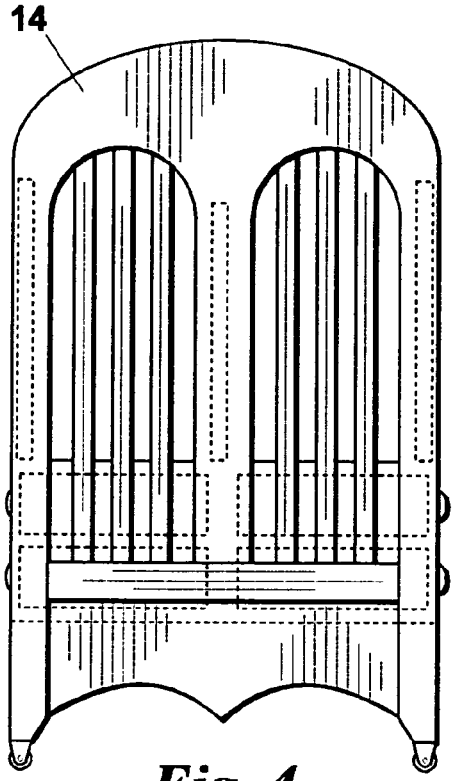
FIG. 4 is a front end view of the bed looking from the foot board end.
Figure 5:
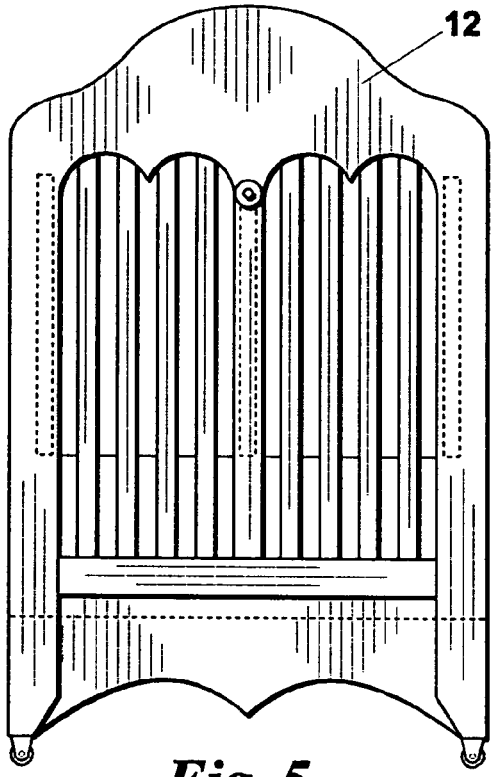
FIG. 5 is a rear end view looking from the headboard end.

Preferably, each side of the bed, below the deck 16, is provided with four drawers 42 as best shown in FIGS. 1 and 2. It should be understood that four drawers 42 are also provided on the side of the bed opposite from that shown in FIGS. 1 and 2.

For the purpose of providing comfort and amusement to occupants of the bed 10, a mobile (not shown in any detail) can be provided on the headboard 22, for example at the location"A". The mobile is preferably of one of the several types disclosed in Zisholtz U.S. Pat. No. 4,640,834, the disclosure of which is fully incorporated herein by reference. The voice actuated feature of Zisholtz will also be employed herein. For further enjoyment or comfort, a light scene is preferably located at location "B" on the headboard 12. The light scene can be of the type disclosed in U.S. Pat. No. 6,256,811 B1 issuing to Nelson on Jul. 10, 2001, the disclosure of which is fully incorporated herein by reference. As an alternative, the locations A and B can be utilized to feature the stereo speakers of U.S. Pat. No. 3,934,284 issuing to Paletta et al on Jan. 27, 1976, the disclosure of which is fully incorporated herein by reference.

Whereas the present invention has been described in particular relation to the drawings attached hereto, it should be understood that other and further modifications, apart from those shown or suggested herein, may be made within the spirit and scope of this invention.

What is claimed is:

1. A generally rectangular baby bed comprised of a vertical headboard, a vertical footboard arranged in spaced parallel relation with the headboard, a pair of vertical side panels connecting from the headboard to the footboard, a flat horizontal supporting surface extending between the headboard and the footboard for supporting a mattress thereon, a pair of vertical side panels extending between the headboard and the footboard and each pamel being formed of horizontal rails extending between the footboard and the headboard and vertical rails extending downwardly from the horizontal rails to the horizontal supporting surface, a central vertical partition mounted between the side panels in parallel relation therewith and extending from the headboard to the footboard, the central partition being formed of an upper horizontal rail, a lower horizontal rail and a plurality of vertical rails which extend from the upper rail of the partition to the lower rail thereof, a pair of opposed vertical slots located opposite each other on the inboard sides of the headboard and footboard for receiving therein the ends of the upper and lower horizontal rails of the vertical partition whereby the vertical partition is slidable vertically upwardly and downwardly in the vertical slots, rollers mounted at the ends of the horizontal rails for the central partition for allowing rolling movement of the vertical partition in the vertical slots.

2. A baby bed as set forth in claim 1 wherein a locking device is provided to prevent lifting of the central partition in the vertical slots, the locking device consisting of a rod extending from the outboard side of one of the headboard or footboard and extending through a hole in the headboard or footboard so that the inner portion of the rod extends over a roller on the end of one of the horizontal rails of the partition.

3. A baby bed as set forth in claim 1 wherein a separate mattress is supplied on the horizontal supporting surface on either side of the partition.

4. A baby bed as set forth in claim 1 wherein a mobile is provided on the headboard to provide music.

5. A baby bed as set forth in claim 1 wherein a light scene is attached to the headboard or the footboard.

* * * * *